United States Patent [19]

Baker et al.

[11] Patent Number: 4,877,179

[45] Date of Patent: Oct. 31, 1989

[54] FAREBOX SECURITY DEVICE

[75] Inventors: Joseph R. Baker, San Diego; Wesley A. Golland, La Jolla; Paul A. Mullens, Roger B. Trimble, both of San Diego, all of Calif.

[73] Assignee: Cubic Western Data Corporation, San Diego, Calif.

[21] Appl. No.: 176,165

[22] Filed: Mar. 31, 1988

Related U.S. Application Data

[60] Division of Ser. No. 114,565, Oct. 29, 1987, which is a continuation of Ser. No. 750,534, Jun. 28, 1985.

[51] Int. Cl.[4] ..... G07B 15/00

[52] U.S. Cl. ..... 232/7; 232/15

[58] Field of Search ..... 232/7, 15, 16, 14

[56] References Cited

U.S. PATENT DOCUMENTS 3,966,116 6/1976 Dominick et al. ..... 232/7

4,201,333 5/1980 Oslin et al. ..... 232/7

4,471,905 9/1984 Sloma et al. ..... 232/15

*Primary Examiner*—Robert W. Gibson, Jr.

*Attorney, Agent, or Firm*—Brown, Martin, Haller & McClain

[57] ABSTRACT

A fare box has two separate chambers connected together by a connecting opening, with a fare receiving module in one of the chambers for receiving deposited fares and transporting them to the connecting opening, and a cashbox in the other chamber for receiving fares deposited in the connecting opening. A locking device is associated with the fare receiving module for releasably retaining it in the first chamber, and a security shutter in the housing is moveable between a first position blocking the connecting opening and a second position in which the opening is unblocked. The security shutter and locking device are linked together so that the connecting opening is blocked whenever the fare receiving module is released.

3 Claims, 4 Drawing Sheets

FAREBOX SECURITY DEVICE

CROSS REFERENCE TO RELATED U.S. PATENT APPLICATIONS

This application is a division of pending application Ser. No. 114,565, filed Oct. 29, 1987, which was a continuation of application Ser. No. 750,534 filed June 28, 1985.

BACKGROUND OF THE INVENTION

The present invention relates generally to fareboxes and more specifically to security devices for automatically securing cash storage areas in fareboxes when they are opened for maintenance purposes. The invention is particularly intended for use with a farebox of the type in which a fare receiving module of a farebox is removable for maintenance purposes.

Fareboxes or cash acceptance receptacles, for example of the type used to collect fares from transit passengers automatically, typically comprise an outer receptacle in which a secure cashbox is located, and have some means for detecting the deposit of coins and/or bills and registering the appropriate payment. A suitable coin and/or bill deposit section is provided in the receptacle and guides deposited cash into the cashbox. The cashbox has openings which are automatically closed and locked when the receptacle is opened to allow the cashbox to be removed and replaced when full. These openings are open to allow the deposit of cash from the deposit section when the cashbox is securely locked within the farebox. Thus, there is a security problem if anyone gains access to the interior of the deposit section of the farebox while the cashbox is in place.

SUMMARY OF THE INVENTION

According to the present invention a farebox is provided which has two separate chambers with a least one connecting passageway between the chambers and a security shutter movable between a position blocking the passageway and a position in which the passageway is unblocked and open. At least one fare receiving module is located in a first one of the chambers for receiving fares deposited in an associated aperture in the housing, and includes an apparatus or device for detecting the value of a deposited fare and a transport mechanism for transporting the deposited fare through the module to the connecting passageway. The fare receiving module is associated with a locking device for releasably locking the module in the chamber. The locking device is associated with the security shutter such that unlocking of the fare receiving module to remove the module from the housing automatically moves the shutter into the position blocking the passageway and locks it in that position until the module is again replaced and locked in the housing.

A cashbox is located in the second chamber with at least one fare receiving opening communicating with the connecting passageway between the chambers to receive fares from the fare receiving module and to store accumulated fare deposits. The cashbox is removably locked in the chamber and itself has a security shutter or blocking plate which automatically closes and locks any fare receiving opening when the cashbox is released from the chamber.

Thus, the farebox is doubly secure, since not only is the cashbox automatically closed and locked prior to its removal from the housing for emptying, for example, but a connecting passageway which connects a fare receiving and detecting module to the cashbox is also automatically closed and locked if the module has to be remove, for example for maintenance purposes. Thus, unauthorized access or entry to the cashbox chamber is prevented, reducing the risk of theft.

Preferably, the locking device comprises a key member rotatably mounted on the fare receiving module and a lock device in the chamber for engagement by the key when the module is correctly positioned in the chamber. The shutter device is linked to the lock device so that rotation of the key in a first direction acts both to lock the key member in the lock device and therefore the fare receiving module in the chamber and also to move the shutter out to the passageway to allow fares to be deposited in the cashbox.

Rotation of the key in an opposite, unlocking direction acts to release the key and module from the lock and to move the shutter in the opposite direction into a position blocking the passageway, where it will be locked in place until the key is again inserted and rotated in the first direction.

Still other objects and advantages of the present invention will become more apparent when the invention's detailed description is read in conjunction with the below-described drawings.

DETAILED DESCRIPTION OF THE PREFERRED EMBODIMENT

Figure 1:
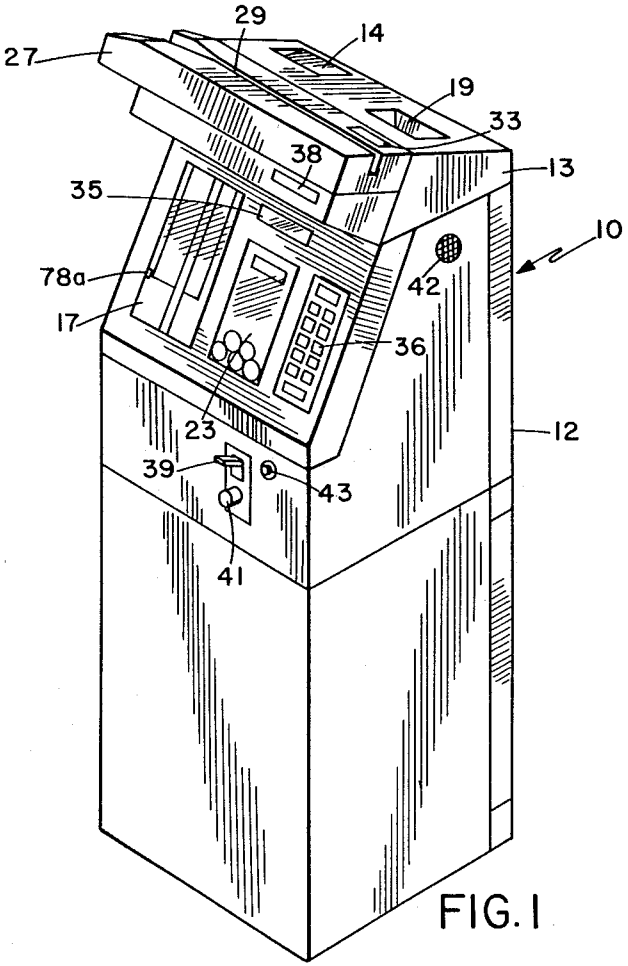
FIG. 1 is a perspective view of the farebox of the invention from the point of view of a farebox operator.

FIG. 1 of the drawings shows a farebox 10 incorporating a security shutter and locking device according to a preferred embodiment of the present invention. The farebox is preferably of the type described in copending U.S. Pat. application Ser. No. 114,565 referred to above. The farebox 10 is shown in FIG. 1 from the perspective of a farebox operator. It is contemplated that the farebox 10 would be used, for example, on a bus in an urban mass transportation system for conducting transit fare transactions with passengers upon their entering the bus. Thus, the farebox 10 would be located immediately adjacent the bus driver at the point of entry of passengers into the bus. The driver, in addition to operating the bus, controls and monitors the operation of the farebox 10.

Generally, each fare transaction conducted by the farebox 10 will involve the receipt by the farebox 10 of a payment by a passenger for riding the bus. Such payment can be made by any one of a plurality of fare payment media. In the preferred embodiment, fare payment media that are accepted by the farebox 10 during the processing of fare transactions include currency in the form of bills, tickets having predetermined lengths, with each length corresponding to a prepaid fare, coins, tokens, and farecards bearing magnetically-encoded signals in a strip of magnetic material. Other forms of fare payment that are acceptable to the farebox 10 are prepaid passes or prepaid transfers.

A fare transaction is initiated by a passenger upon entering the bus by tendering a fare payment medium to the farebox.

In conducting a fare transaction the farebox 10 has the ability to respond to the provision of bills, tickets, coins, tokens, or farecards by passengers and to register fare payment. The farebox's ability to register fare payment includes the ability to determine from the medium tendered the amount of the tender and to decide whether the amount tendered equals or exceeds a predetermined fare tariff. If the amount tendered is sufficient to pay the fare, the farebox acknowledges and records payment.

Figure 2:
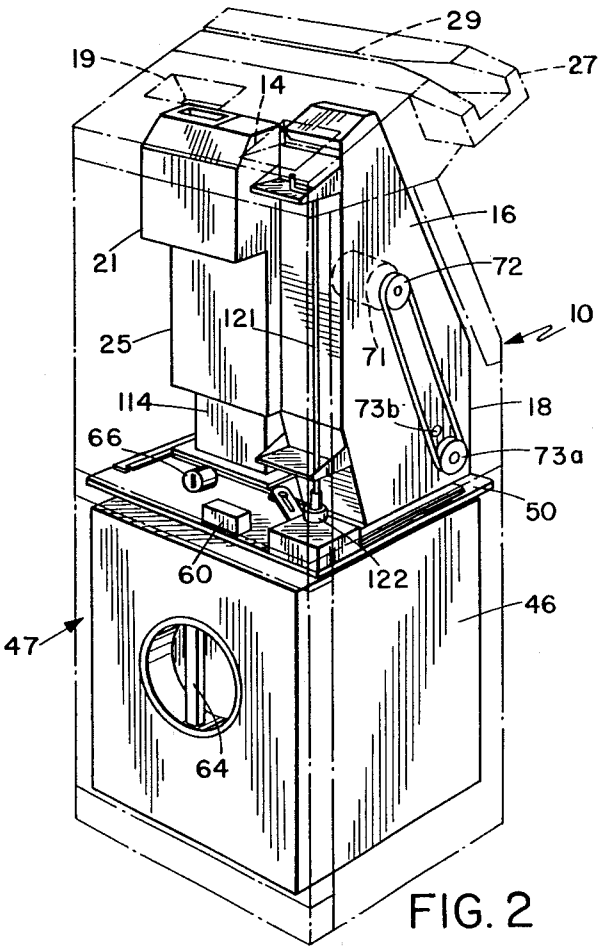
FIG. 2 is another perspective view of the farebox of the invention showing the farebox housing in broken line and showing, in solid line, critical components of the farebox that are contained within the housing.

Refer now to FIG. 1 and FIG. 2. FIG. 2 illustrates the farebox 10 from the perspective of a passenger entering a bus. The farebox housing 12 includes an upper portion 13 having an inclined aperture 14 for accepting currency bills and tickets. The bills and tickets inserted into the aperture 14 by a passenger are transported one at a time by a bill feeder and detector module (bill module) 16 from the aperture 14 to an escrow window 17 visible to the driver. From the escrow window 17, the bill module 16 feeds bills along a path of travel 18 which carries bills and tickets further into the interior of the housing 12.

A coin acceptor aperture 19 is located in the upper housing portion 13 through which coins and tokens are fed by a bus passenger into a coin singulator and discriminator module (coin module) 21. Coins and tokens are fed through the coin module 21 to a coin escrow window 23 that is visible to the bus driver. From the escrow window 23, coins and tokens are carried by a coin chute 25 further into the interior of the farebox 10.

A magnetic fare card reader 27 is fastened to the upper housing portion 13 and includes a reader slot 29 through which a farecard having magnetically-encoded fare data is manually swiped by a passenger who retains physical control of the farecard during its travel through the slot 29.

A passenger value alphanumeric display 33 is positioned on the magnetic farecard reader 27 where it is visible to a passenger. A drive/operator value alphanumeric display 35 is located on the driver's side of the farebox where it is visible to the driver alone. An alphanumeric entry keyboard 36 is also located on the driver's side of the farebox 10 adjacent the coin escrow window 23 and the driver value display 35. A driver-/operator status display 38 is positioned on the side of the magnetic farecard reader 27 that is visible only to the driver.

Other controls available to the driver and located on the driver's side of the farebox 10 include a manual coin dump lever 39 and an override/bypass lever 41. Finally, a speaker 42 is located on one side of the farebox where it emits tones and predetermined voice messages that are audible to both the driver and a passenger.

A cashbox 46 is securely held in a chamber 47 in the lower portion of the farebox 10. In the farebox and above the cashbox 46 is located a security plate 50 separating the upper portion of the farebox containing the bill and coin modules 16 and 21 and the lower chamber 47 containing the cashbox 46. An electronic lock 60 is securely mounted to the inside of the housing over the security plate 50 immediately above the top of the cashbox 46. A manually-operated lock handle 64 is located on the front of the cashbox 46. On the wall of the farebox 10 that faces a passenger is located a receptacle 66 for receiving a station communications probe (not shown) that is used when the bus is delivered to a bus terminal for removal of the cash box 46.

Figure 3:
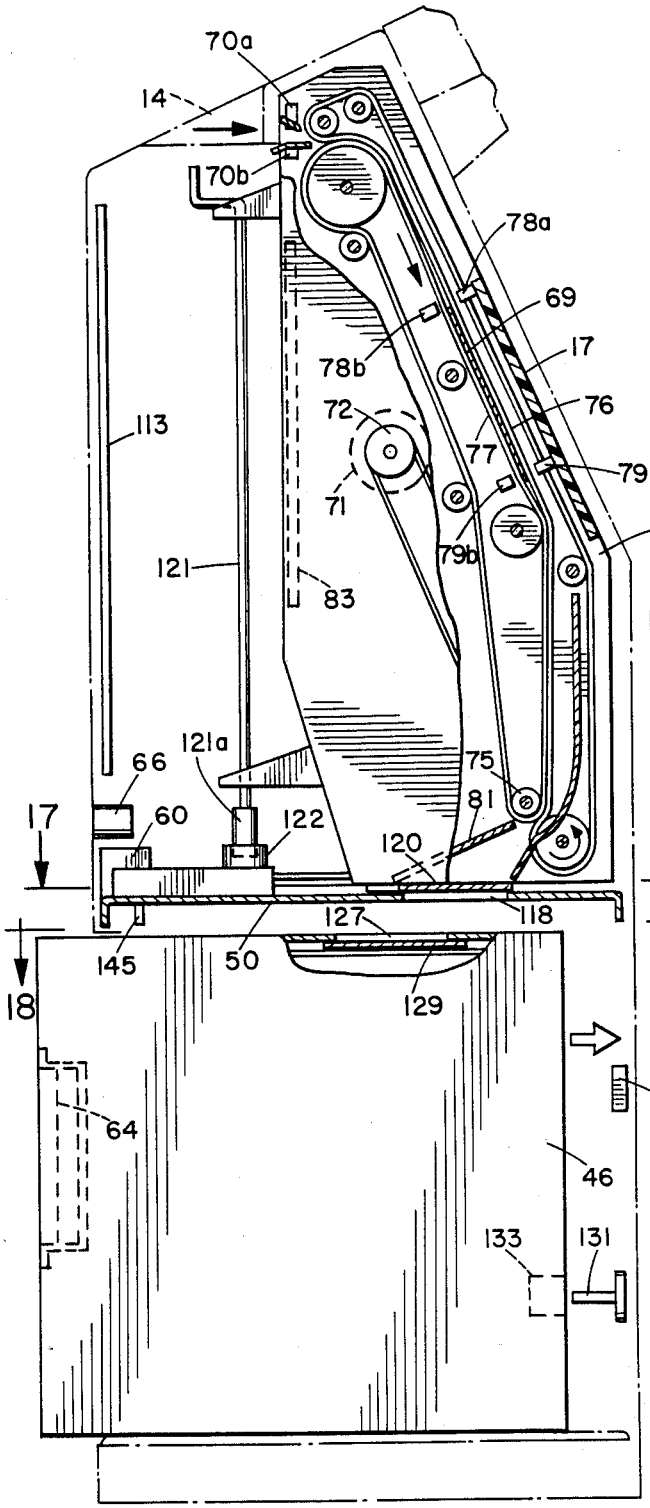
FIG. 3 is a cutaway view of one side of the farebox showing a bill module for feeding a bill from a bill entry aperture to a cashbox while detecting the length of the bill.
Figure 3A:
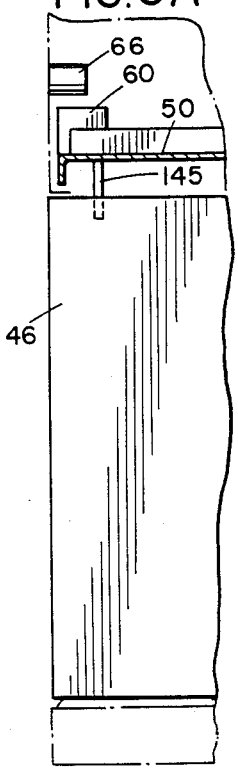
FIG. 3A is an enlarged view of the front of the cashbox of FIG. 3 showing the cashbox seated and locked in the farebox.
Figure 4A:
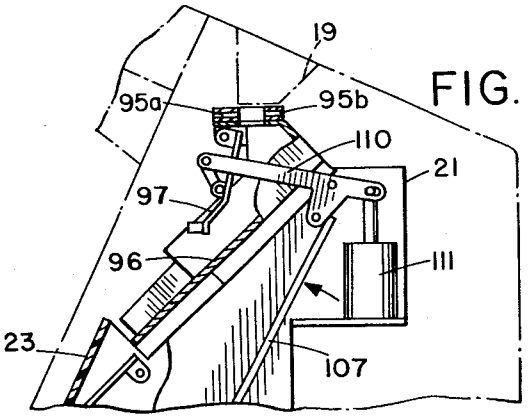
FIG. 4A is an enlarged sectional view of a portion of a coin feed mechanism in the coin module of FIG. 4.

Refer now to FIGS. 2 and 3 for an understanding of the structure of the bill feeder and detector module 16. During operation, the bill aperture 14 is illuminated by means not shown and will accept any United States currency note in circulation. In addition, passengers may purchase tickets such as preprinted cardboard tickets which are produced in respective lengths, with the length of a prepaid ticket corresponding to fare value prepaid by the passenger holding the ticket. The lengths of prepaid tickets differ from the length of a United States currency bill. The fare processing described below assumes that recognized currency bills are one dollar in value, without regard to the actual value of the bill. Thus, a one hundred dollar bill will be recognized and accorded a value of one dollar.

A bill is entered through the bill acceptor aperture 14 in the direction of the arrow shown. When the bill enters the housing of the bill module 16 through the aperture 14, its leading edge is detected by an optical sensor pair **70*a* and 70*b*. When the edge of the bill passes between the sensor pair, the sensor pair provide a BILL PRESENT signal to a fare processor, described below, which, in response, transmits a START MOTOR signal to the bill module 16. The START MOTOR signal causes a conventional motor 71 to rotate. A drive pulley 72 connected to the output shaft of the motor 71 provides power through a drive belt to a pair of geared pulleys 73*a* and 73*b*. The geared pulley 73*a* is rotated by the belt that engages the motor pulley 72 and, in rotating, causes the geared pulley 73*b*** to rotate.

The geared pulleys **73*a* and 73*b* are conventionally connected to drive pulleys 74 and 75, respectively, that are conventionally rotatably mounted on shafts in the interior of the bill module 16. Rotation of the drive pulleys 74 and 75 causes a pair of endless transport belts 76 and 77 to begin rotating so as to nip the leading edge of a bill entered through the aperture 14 and to transport the bill in the interior of the bill module 16 towards the escrow window 17. The escrow window 17 is formed from a clear transparent material and is an integral part of the bill module 16. When the trailing edge of the bill is transported by the endless belts 76 and 77 to a location between an optical sensor pair 78*a* and 78*b*, the sensor pair 78*a* and 78*b* cause a MEASURE BILL signal to be sent to the fare processor described below which, in turn, issues a signal to stop the motor 71 rotating for a predetermined period of time. Immediately after the motor 71 ceases rotation, another optical sensor pair 79a and 79b are sampled to determine whether the leading edge of the bill blocks the sensor pair or not. If the bill trailing edge does not block the sensor pair, it is determined to be of a predetermined length corresponding to a prepaid ticket having a certain equivalent cash value. If the sensor pair 79a and 79b is blocked, the bill is determined to be a U.S. currency bill of one dollar denomination. Since the bill is halted immediately under the escrow window 17**, the demination of the bill can be confirmed visually by the farebox operator.

After the elapse of a predetermined amount of time after the trailing edge of the bill passes the optical sensor pair 78a and 78b, or if the operator touches a DUMP key on the keyboard 36, the motor 71 is once again activated, causing the belts 76 and 77 to begin rotating again in a direction that carries the bill downwardly in the bill module toward the drive rollers 74 and 75. As the bill is transported between the rollers 74 and 75 it is guided by the plate 81 out the bottom of the bill module 16. After a predetermined period of time, if another BILL PRESENT signal has not been received, the fare processor will remove the signal enabling the motor 71 to rotate. If another ticket or bill has been detected by the sensing pair 70a and 70b, the morot 71 will continue rotating and the sequence described above will repeat.

A printed circuitboard assembly 83 provides conventional interface circuitry for receiving, formatting, and forwarding signals from the optical sensor pairs 70a and 70b, 78a and 78b, and 79a and 79b. The printed circuitboard assembly 83 also carries conventional circuitry for forwarding sensor signals from the coin module to the below-described fare processor.

Reference to FIGS. 2, 4, and 4A, and 6 will provide an understanding of the structure and operation of the coin singulator and discriminator module 21. The coin aperture 19 is also illuminated (by means not illustrated) to aid the passenger in locating it. The passenger inserts coins or tokens of predetermined denominations into the coin aperture where they fall into the coin singulator and discriminator module 21. Coins fall from the aperture 19 past a set of optical sensor pairs, one pair shown as 95a and 95b, onto a sloped ramp surface 96 whereupon they travel for a short distance until their direction is changed by a ramped guide flange that forms a conventional hopper 97. The hopper translates the motion of coins moving on the surface 96 toward a conventional coin singulator mechanism 99.

The sensors 95a and 95b indicate the presence of coins in the module by COIN PRESENT, signals sent to fare processor. In response, the fare processor sends a RUN SINGULATOR signal to turn on the coin singulator mechanism in 99. Then, by the time coins reach the mechanism 99, the mechanism is operating, ready to separate the coins.

The hopper 97 includes an electrostatic sensor, not shown, that detects and indicates to the fare processor the presence of a coin in the singulator mechanism 99. So long as the electrostatic sensor detects presence of a coin in the mechanism 99 the below-described fare processor responds by maintaining the signal to the singulator mechanism 99 that enables the singulator to continue operation.

The hopper 97 and the singulator mechanism 99 operate conventionally to feed coins one-by-one in a sequence through a coin discriminator 100. The coin discriminator 100 detects the denomination of each coin in the sequence provided by the singulator mechanism 99 and provides signals to the fare processor indicating first the presence of a coin (COIN PRESENT) and second the denomination of the coin (penny, dime, . . . token, or tokens).

Coins pass through the discriminator 100 and fall on a plate 101 hinged at hinge 102. In the hinged plate's normal position, its end contacts a coin retaining wall 103 to stop the movement of coins through the coin module 21 under the escrow window 23. As coins collect under the escrow window 23, their denominations can be confirmed visually by the driver.

The end of the hinged plate 101 is pulled away from the coin retaining wall 103 by a pivoted plate retraction linkage 104. The plate retraction linkage is pivoted either by a solenoid 105 or by a manual coin dump lever arm 106 connected to and operated by the manual coin dump lever 39. Thus coins can be dropped from under the escrow window either by the driver's operation of the dump lever 39 or automatically by the action of the solenoid 105. The solenoid is activated in response to a signal received from the below-described fare processor. In normal operation, the solenoid 105 is operated to dump coins after the elapse of a 10-second timeout period that is initiated when the electrostatic sensor in the singulator mechanism 99 detects no coins. Another sensor, not shown, on the plate 101 detects when enough coins have collected in the plate 101 before lapse of the time period to cover a predetermined position of the plate 101. This sensor then provides a HOPPER FULL signal to the fare processor and the fare processor operates the solenoid 105 to drive the coins.

When coins are dumped either manually or automatically, they fall through a chute 114 out an opening in the bottom of the coin module 21.

The automatic operation of the coin module singulator mechanism 99 and coin discriminator 100 can be overridden either automatically or manually. Manual override is provided by depression of the override lever 49 by a driver. Depression of the override button 49 causes an override shaft 107 to pivot on pivot point 108 in the direction of the arrow in FIG. 4A. The shaft 107 moves a linkage assembly 110, which movement lifts the hopper 97 off of the sloped surface 96. When the ramped guide plate is lifted from the surface 96, coins fall directly through the aperture 19 along the sloped surface 96 onto the hinged plate 101. Once the override lever is depressed, the coin module 21 will not operate automatically until the farebox is reset by a supervisor.

The linkage mechanism 110 can also be operated by a solenoid 111 that is activated by the below-described fare processor when the fare processor detects that the singulator mechanism 99 has jammed.

A printed circuitboard assembly 112 is mounted on the lower back portion of the coin module 21. The printed circuitboard assembly 112 contains conventional circuitry for receiving optical sensor signals from the singulator mechanism 99 and coin present and coin denomination signals from the coin discriminator 110. The conventional circuitry on the circuitboard assembly further formats those signals and forwards them over conventional cable means, not shown, to the below-described fare processor that is located on another fare processor printed circuitboard assembly 113 mounted on the interior backwall of the upper portion of the farebox 10. FIGS. 2, 3, 3A, and 4, the interior of the farebox housing 12 is divided approximately in half by a security plate 50 that is fixedly attached to the interior of the housing. The security plate 50 has a bill aperture 118 (FIGS. 3 and 17) that communicates with the bottom of the bill module 16 and provides an opening for bills and tickets to fall from the bill module 16 downwardly through the plate 50. A coin aperture 119 (FIGS. 4 and 17) is provided in the security plate underneath the coin module 21 and in alignment with the bottom of the coin 114. Attached to the housing 12 adjacent security plate 50 and centered over the coin aperture 119 is a plate coin chute 116 that provides a continuous path of travel for coins dumped from the coin module 21, the path of travel extending from the coin module coin chute 114 through the security plate coin chute 116 and downwardly through the security plate coin aperture 119. The security plate coin chute 116 has a conventional "anti-fish" funnel construction with a pair of oppositely-directed ramped surfaces 117*a* and 117*b* to prevent a person reaching through the coin aperture 119 should the coin module 21 be removed from the farebox 10.

When the bill module 16 is removed from the farebox, the bill and coin apertures 118 and 119 in the security plate 50 are closed by a shutter 120. The shutter is slidably attached to the upperside of the security plate 50 and slides between a first position away from the apertures 118 and 119 (shown in FIG. 4) and a second position closing both of the apertures (FIGS. 3 and 17).

The shutter 120 is slidably moved between the two positions by a linkage apparatus including a shutter rotating rod 121 that is rotatably attached to the bill module 16, a keyed pin-and-socket linkage 122 and a slide linkage arm 124. When the rod 121 is rotated to one position, it rotates the linkage 124. As best seen in FIG. 17, a slot 124*a* in the 124 draws the shutter 120 by means of a trunnion 125 attached to the shutter that extends through the slot. Rotation of the rod 121 in the other direction causes the shutter to move to the other position.

The rotating rod 121 can be detached from the shutter linkage mechanism 122 only when the keyed end 121A of the rod 121 is rotated to a position that closes the shutter 120. Therefore, extraction of the bill module requires rotation of the rod which closes the shutter 120 and prevents unauthorized entry into the cashbox 64.

Reference to FIGS. 2–5 and 8 will provide an understanding of insertion, operation, and removal of the cashbox 46. The cashbox is shown partially inserted into the farebox in FIG. 3, fully inserted in FIGS. 2, 3A, and 4, and removed from the farebox in FIG. 5. Secure cashboxes such as the cashbox 46 are known, one instantiation being described in the U.S. patent application entitled "SECURITY VAULT SYSTEM, " Ser. No. 742,295, Filed: June 7, 1985, Inventors: Ronald L. Hempfling et al., and assigned to the assignee of this patent application.

Figure 5:
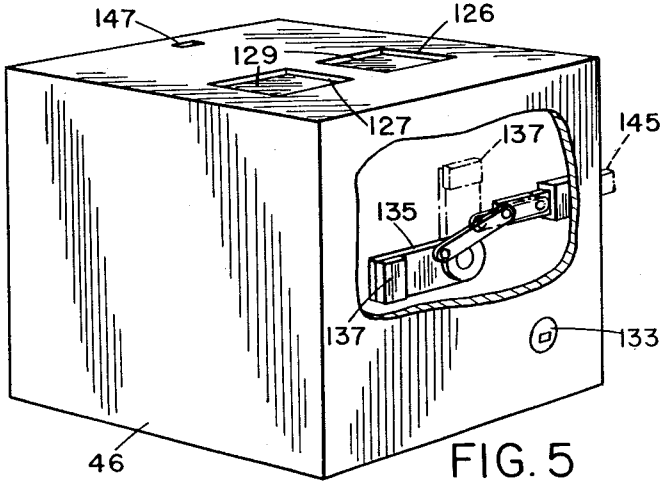
FIG. 5 is a perspective view of the cashbox removed from the farebox.
Figure 4:
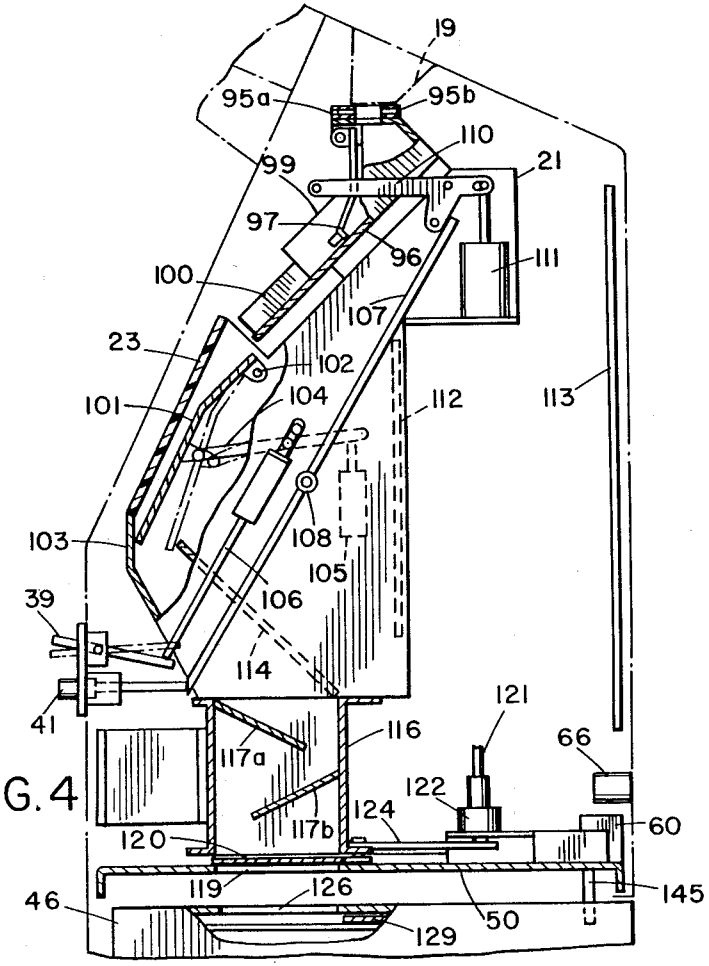
FIG. 4 is a cutaway view of another side of the farebox showing a coin module for sequencing and feeding coins from a coin entry aperture to the cashbox while detecting the denomination of each coin in the sequence.
Figure 6:
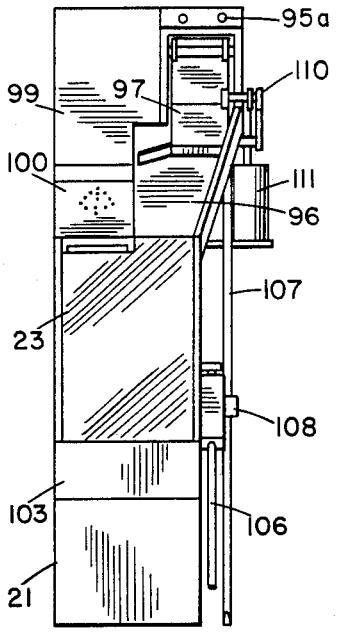
FIG. 6 is a front view of the coin module of FIG. 4.
Figure 7:
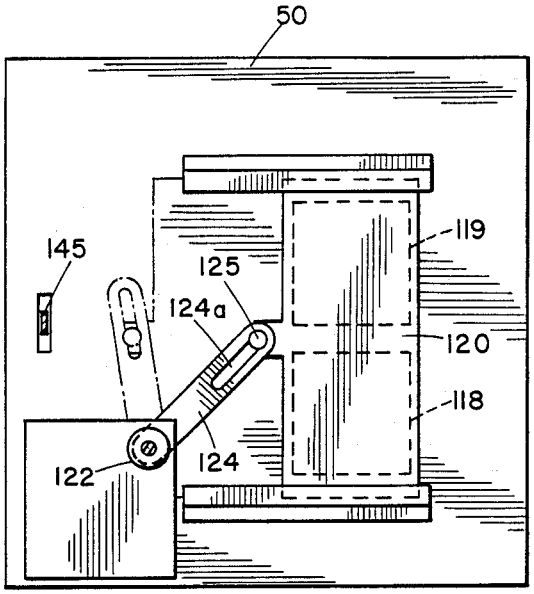
FIG. 7 is a sectional view taken along 7—7 of FIG. 3.
Figure 8:
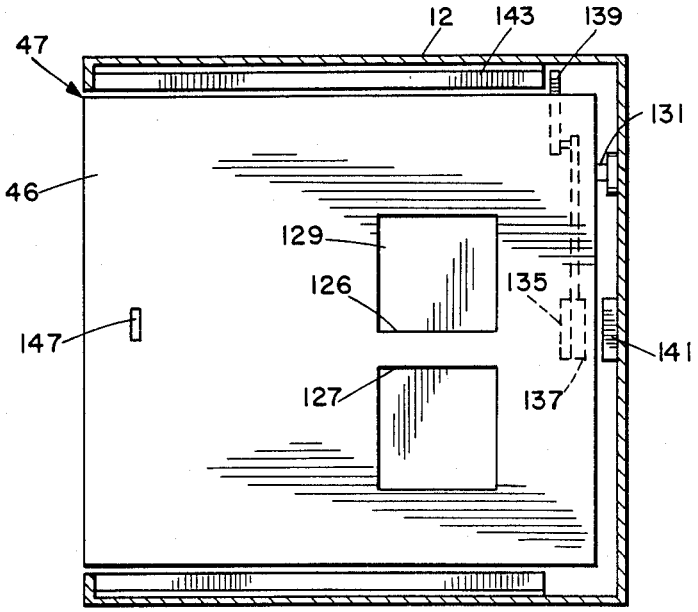
FIG. 8 is a sectional view of the fare box taken along 8—8 of FIG. 3.

As best seen in FIGS. 5 and 8, the cashbox 46 includes a pair of apertures 126 and 127 through which bills and coins, respectively, pass to be collected in separate compartments (not shown) in the interior of the cashbox 46. One compartment is for the collection of bills and tickets; the other for the collection of coins and tokens. The structure of the cashbox 46 includes a top cover formed from a pair of parallel plates that sandwich an interlock mechanism (not shown) that couples the rotatable lock handle 64 to a sliding shutter 129. The interlock mechanism is described in detail in the Hempfling et al. patent application, which is incorporated herein by reference. The internal interlock mechanism is actuated by the rotatable handle 64. When the handle is rotated to a locked position, the internal mechanism slides the shutter 129 to a position that closes the bill and coin apertures 126 and 127. Rotation of the handle to an unlocked position causes the interlocking mechanism to slide the shutter 129 to a position away from the apertures 126 and 127 so that bills and coins can fall into their respective compartments internal to the cashbox 46. The shutter 129 is shown in the locked position in FIGS. 3 and 5 where the cashbox is either partially inserted into the farebox or removed from the farebox. It should be evident that the positioning of the shutter to close the bill and coin apertures of the cashbox 46 before the cashbox is fully inserted in the farebox 10 is necessary to prevent unauthorized entry into the collection chambers of the cashbox.

When the cashbox is not seated in the farebox, as seen in FIG. 3, the handle 64 is normally locked against rotation and is released when the cashbox 46 is placed in the farebox chamber 47 by a magnetic key pin 131 (FIGS. 3 and 18) projecting from the lower housing into the interior of the chamber 47. When the cashbox 46 is slid into the chamber as in FIG. 18, the magnetic key pin 131 enters a key slot 133. The key slot 133 admits the magnetic key pin 131 into the interior of the cashbox 46 where the key pin unlocks the interlocking mechanism, permitting the handle 64 to be rotated in a direction that causes the interlocking mechanism to slide the shutter 129 to the unlocked position opening the apertures 126 and 127.

Obviously many modifications and variations of the above-described farebox are possible in light of the foregoing teachings, and it is therefore understood that the invention may be practiced otherwise than as specifically described.

We claim:

1. A farebox comprising:

a housing having two separate chambers with a connecting opening communicating between said two chambers;

a fare receiving module located in a first one of said chambers and having means for receiving fares deposited in the housing, and means for transporting deposited fares to said connecting opening;

a locking device associated with the fare receiving module for releasably retaining said module in the first chamber;

a security shutter in the housing movable between a first position blocking said connecting opening and a second position in which the opening is unblocked;

a cashbox located in the second of said chambers and having at least one deposit opening communicating with said connecting opening for receiving fares deposited in said connecting opening by the fare receiving module; and linkage means linking said security shutter to said locking device for moving said security shutter into said first position in response to unlocking of said locking device to release the fare receiving module from the housing and moving said security shutter into said second position in response to locking of said locking device to secure said module in said housing.

2. The farebox as claimed in claim 1, wherein the locking device comprises a key member rotatably mounted on the fare receiving module, and a socket linkage mechanism mounted in the first chamber for engagement with the key member when the module is positioned in the chamber, the key member being rotatable when engaged in the socket linkage mechanism between a locked position in which it is retained in said socket linkage mechanism and a released position in which it is removable from said socket linkage mechanism.

3. The farebox as claimed in claim 2, wherein said socket linkage mechanism comprises an arm rotatably connected at one end to said socket linkage mechanism, and at the other end to said shutter.

* * * * *

UNITED STATES PATENT AND TRADEMARK OFFICE

CERTIFICATE OF CORRECTION

PATENT NO. : 4,877,179

DATED : October 31, 1989

INVENTOR(S) : Charles W. Giebelhausen

It is certified that error appears in the above-identified patent and that said Letters Patent is hereby corrected as shown below:

In the heading the inventors are improperly showns as

Joseph R. Baker, Wesley A. Golland,
Paul A. Mullens and Roger B. Trimble

The patent should show the inventor as:

--Charles W. Giebelhausen--

Signed and Sealed this

Sixth Day of November, 1990

*Attest:*

HARRY F. MANBECK, JR.

*Attesting Officer*

*Commissioner of Patents and Trademarks*